US010765216B1

(12) United States Patent
Shi

(10) Patent No.: US 10,765,216 B1
(45) Date of Patent: Sep. 8, 2020

(54) HINGED CHAIR WITH ROTATABLE FOLD-DOWN BACK

(71) Applicant: BeiHeng Shi, Shanghai (CN)

(72) Inventor: BeiHeng Shi, Shanghai (CN)

( * ) Notice: Subject to any disclaimer, the term of this patent is extended or adjusted under 35 U.S.C. 154(b) by 0 days.

(21) Appl. No.: 16/277,276

(22) Filed: Feb. 15, 2019

(51) Int. Cl.
*A47C 7/40* (2006.01)

(52) U.S. Cl.
CPC ..... *A47C 7/407* (2013.01)

(58) Field of Classification Search
CPC ..... A47C 7/407; A47C 4/08; B60N 2/206
USPC ..... 297/378.12, 378.1
See application file for complete search history.

(56) References Cited

U.S. PATENT DOCUMENTS 1,791,765 A * 2/1931 Saunders ..... B60N 2/20 403/68
2,400,630 A * 5/1946 Cramer ..... A47C 7/407 297/378.12
3,516,710 A * 6/1970 Sherbert ..... B62D 31/02 297/378.12
3,881,770 A * 5/1975 Cardenas ..... A47C 4/20 297/51
4,045,082 A * 8/1977 Egert ..... A47C 1/026 297/357
4,881,776 A * 11/1989 Wang ..... A47C 7/42 297/378.1
4,969,682 A * 11/1990 Gray ..... B60N 2/20 297/378.1
5,335,971 A * 8/1994 Kelley ..... A47C 4/04 297/378.1
5,520,440 A * 5/1996 Lee ..... B60N 2/20 297/216.13
6,494,539 B2 * 12/2002 Frank ..... A47C 4/04 297/378.1
7,527,337 B2 * 5/2009 Clay ..... A47C 7/407 297/378.12
2002/0096927 A1 * 7/2002 Chen ..... B60N 2/20 297/378.1
2009/0243345 A1 * 10/2009 Carter ..... A01M 31/02 297/16.2

FOREIGN PATENT DOCUMENTS

DE 29720586 U1 * 2/1998 ..... A47C 11/00
JP 2009165790 A * 7/2009 ..... A47C 11/00

* cited by examiner

*Primary Examiner* — Milton Nelson, Jr.
(74) *Attorney, Agent, or Firm* — Morland C. Fischer

(57) ABSTRACT

A hinged chair having a seat, a fold-down back and a base that is detachable from the bottom of the seat to enable the chair to be shipped disassembled in a compact container. The fold-down back is hingedly coupled to the seat by pivots that extend through frame posts at opposite sides of the back. To reduce the profile of the chair, the fold-down back is rotatable at the pivots between a vertical position standing upwardly from the seat and a horizontal position lying over and in opposite facing alignment with the seat. With the chair removed from its shipping container and the chair back rotated to its vertical upstanding position, locking pins are pushed through the frame posts of the back above the pivots to lock the back in the vertical position ready for use.

11 Claims, 5 Drawing Sheets

HINGED CHAIR WITH ROTATABLE FOLD-DOWN BACK

BACKGROUND OF THE INVENTION

1. Field of the Invention

This invention relates to a hinged chair that is capable of being shipped disassembled from the manufacturer to the end user in a compact shipping container so as to reduce both the space consumed by the chair as well as the shipping costs. The hinged chair has a fold-down back that is pivotally connected to a seat and adapted to be rotated between a horizontal folded position laying over and in opposite facing alignment with the seat when the chair is being shipped and a vertical position standing upwardly from the seat when the chair is being used by its purchaser.

2. Background Art

Large pieces of furniture are typically shipped from a location of manufacture to a location of sale and finally to the end user. The bulky nature of the large furniture contributes to the purchase price paid by consumers. That is to say, as a consequence of its space-consuming size, relatively large shipping vehicles and vessels are often required to move the furniture from place-to-place. Moreover, relatively large storage facilities are sometimes necessary to accommodate the furniture while in transit from location-to-location. Unlike smaller articles that are capable of being transported and stored in compact shipping containers, many larger pieces of furniture are not ideally suitable to be palletized. In addition, more than one workman may be necessary to handle the loading and transport of the furniture from its initial point of manufacture to its final point of sale and ultimately to its place of use. In this same regard, purchasers may not be able to easily lift and transport their furniture from the location of purchase to the location of use.

Accordingly, what would be desirable is an article of furniture, such as a chair, that can be shipped, warehoused and carried home disassembled and configured to fit within a compact shipping container, whereby to reduce the cost and inconvenience normally associated with the transport of relatively large articles of furniture from the manufacturer to the end user. It would also be desirable for the furniture to be capable of being quickly and easily assembled by the end user without having a special skill.

SUMMARY OF THE INVENTION

In general terms, disclosed herein is a hinged chair to be used inside and out-of-doors. The chair includes a seat to support the weight of a user, a base with legs to hold the seat above the ground, and a fold-down back against which the user reclines when the chair is in use. The base of the chair is detachable from the seat to enable the chair to be shipped disassembled in a compact shipping container so as to minimize the shipping costs. To further reduce the space consumed by the chair and further minimize the shipping costs, the fold-down back of the chair is pivotally connected to the seat and adapted to be rotated through approximately a 90 degree angle between a horizontal folded position lying over and in opposite facing alignment with the seat when the chair is being shipped and a vertical position standing upwardly from the seat after the chair is unpackaged and assembled for use.

The seat of the hinged chair has a frame with upturned coupling ends extending rearwardly from opposite sides thereof. A hollow hinge enclosure is affixed (e.g., welded) to each of the coupling ends so as to stand upwardly therefrom. The back of the chair has a frame with vertical frame posts running along opposite sides. The lower-most ends of the vertical frame posts of the chair back are received inwardly of respective ones of the hollow hinge enclosures. Prior to shipment of the hinged chair, the fold-down back is pivotally connected by the chair manufacturer to the seat by inserting first couplers (e.g., pivot pins) into pivot receiving slots that are formed in the hinge enclosures and through the lower-most ends of the frame posts received therewithin. Next, the chair back is pulled upwardly and away from the seat such that the frame posts of the frame of the chair back slide upwardly through the hollow hinge enclosures and the pivot pins correspondingly ride upwardly through respective pivot receiving slots. The chair back is then rotated in a clockwise direction at the pivot pins to its horizontal folded position to facilitate shipment of the chair disassembled in its compact container.

After it is purchased and carried to its ultimate destination, the user removes the disassembled chair from the compact shipping container. The base of the chair is then attached to the bottom of the seat by means of fasteners (e.g., screws). Next, the user rotates the chair back in a counter-clockwise direction from the horizontal folded position to its vertically upstanding position. Then, the chair back is pushed downwardly towards the seat such that the frame posts of the frame of the chair back slide downwardly through the hinge enclosures and the pivot pins correspondingly ride downwardly through respective pivot receiving slots. The user inserts second couplers (e.g., locking pins) into the pivot receiving slots of the hinge enclosures and through the lower-most ends of the frame posts so that the locking pins lie above the pivot pins. With the pivot and locking pins now extending through the pivot receiving slots of the hinge enclosures and the frame posts at opposite sides of the frame at the chair back, the chair back can no longer rotate towards its horizontal folded position but is otherwise held stationary and locked in its vertically upstanding position so that the chair is ready for use.

DESCRIPTION OF THE PREFERRED EMBODIMENT

Figure 1:
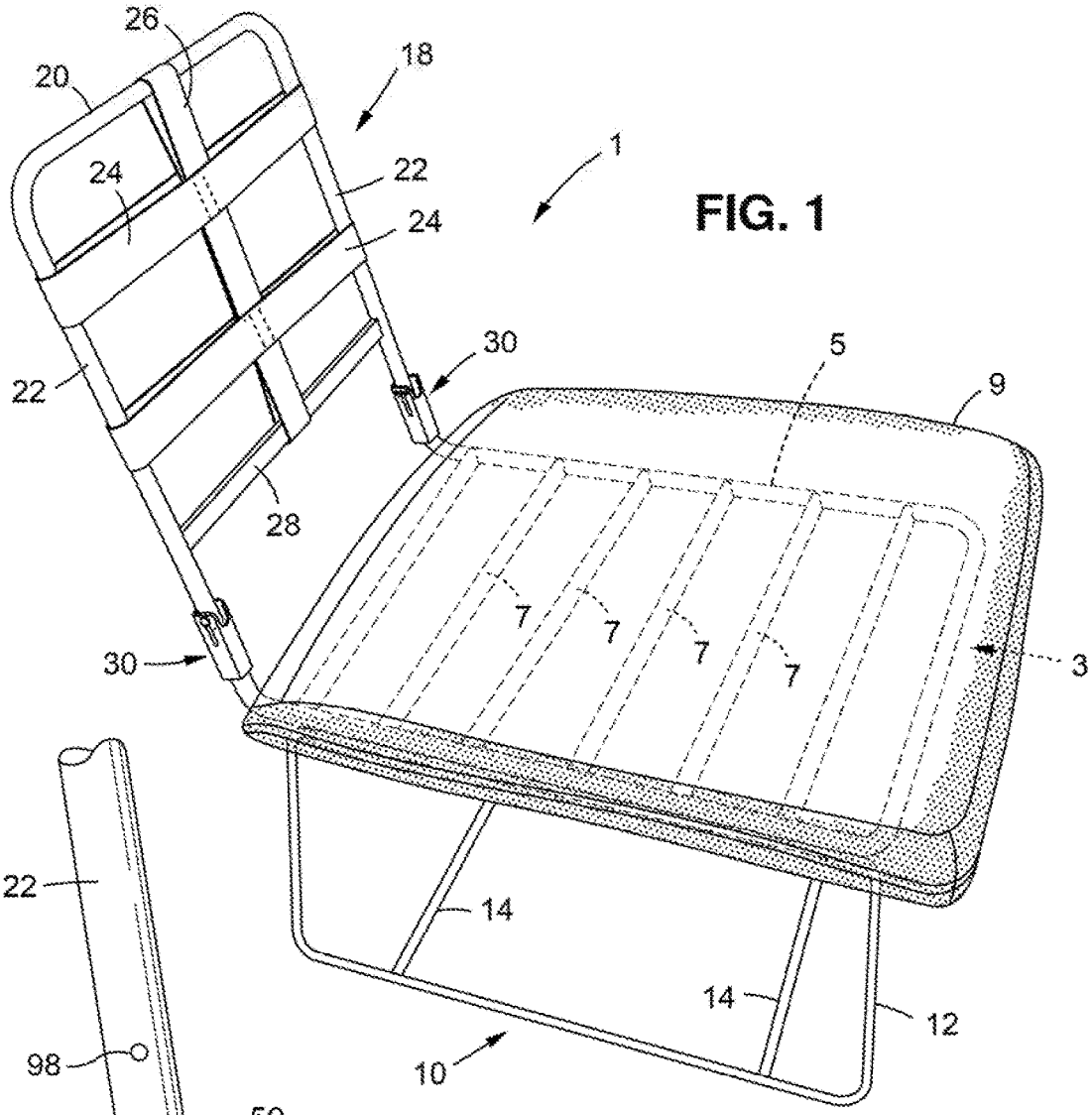
FIG. 1 shows a hinged chair having a rotatable fold-down back according to a preferred embodiment of this invention.
Figure 2:
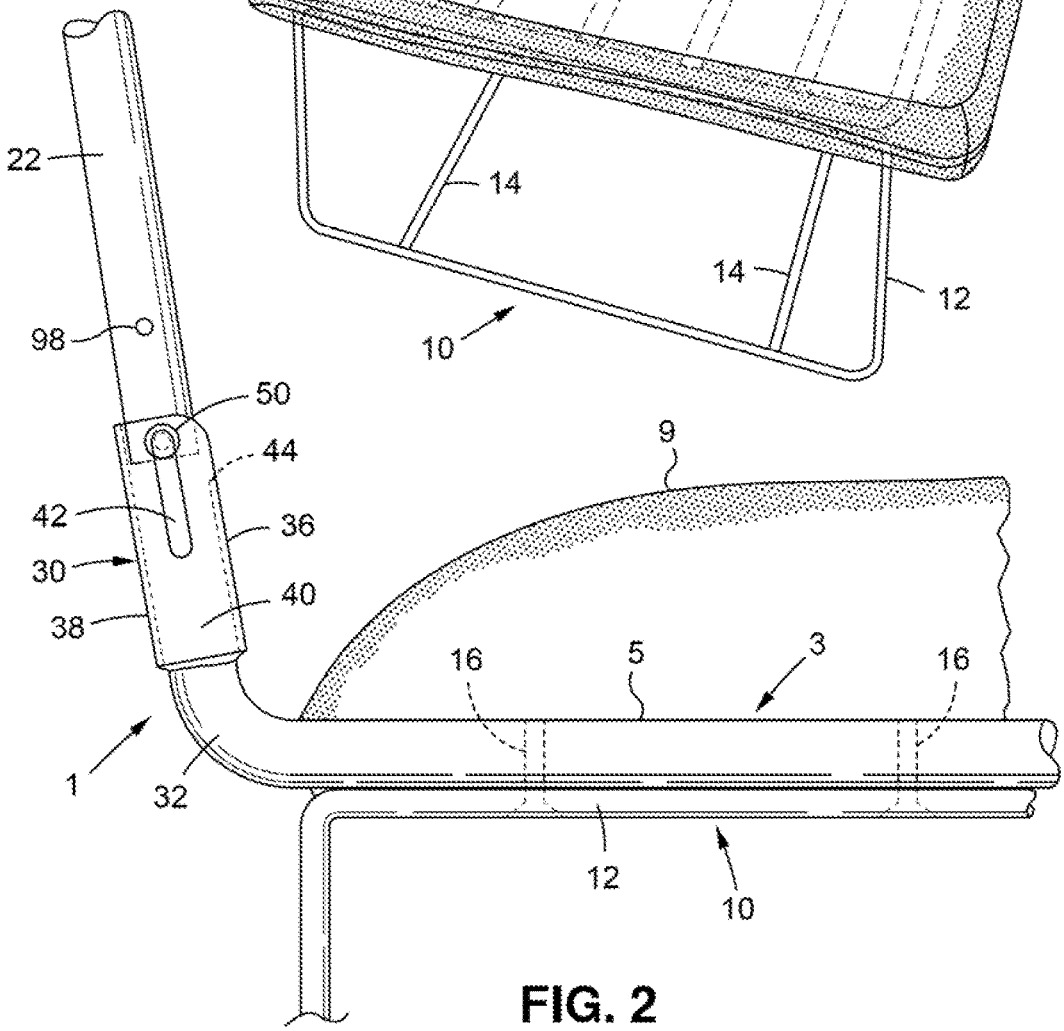
FIG. 2 is an enlarged partial side view of the hinged chair shown in FIG. 1.

Referring initially to FIGS. 1 and 2 of the drawings, there is shown a hinged chair 1 of the kind that has particular application to be used outside. However, the precise location where the chair 1 is used is not to be considered a limitation of this invention, and therefore the chair 1 may be found both inside and out-of-doors. The chair 1 has a flat seat 3 to support the weight of a user. The seat 3 of chair 1 has a tubular, generally rectangular outer frame 5 and a plurality of tubular cross members 7 that run laterally across the outer frame 5 in spaced parallel alignment with one another. A soft cushion 9 is sewn around the top of the seat 3 to enhance the comfort of one seated on the chair 1.

The seat 3 of the chair 1 is held above the ground by a base 10. The base 10 preferably includes a pair of generally rectangular tubular legs 12 that are attached to and extend vertically downwardly from opposite sides of the seat 3. A pair of lateral leg supports 14 run in spaced parallel alignment with one another across the bottom of the base 10 so as to extend between the vertically extending rectangular legs 12 of base 10. The base 10 is detachably connected to the bottom of the seat 3 by means of removable fasteners (e.g., screws) 16. In the embodiment best shown in FIG. 2, pairs of fasteners 16 extend upwardly through the top of each one of the rectangular legs 12 located at opposite sides of the base 10 for connection to the outer frame 5 at opposite sides of the seat 3. The fasteners 16 are withdrawn from the legs 12 and the frame 5 so that the base 10 is disconnected from the seat 3 to enable the chair 1 to be disassembled in order to facilitate a shipment or transport thereof in a compact box or similar container.

The hinged chair 1 also includes a rotatable fold-down back 18 against which the user reclines his back when resting in the seat 3. The back 18 includes a generally rectangular outer frame 20 having a pair of generally vertical tubular frame posts 22 located at opposite sides thereof and standing upwardly from the seat 3. A pair of back support straps 24 against which the user's back is received run laterally across the chair back 18 and in spaced parallel alignment with one another between the frame posts 22. An additional back support strap 26 runs vertically along the chair base 18 from the top of the outer frame 20 to a horizontal strap support 28 that runs between the frame posts 22 below the back support straps 24.

As an important feature of this invention, the fold-down back 18 of the hinged chair 1 is rotatably connected to the seat 3 by means of a pair of hinge enclosures 30. Referring in this regard to FIGS. 2-6 of the drawings, the outer frame 5 of the seat 3 has a pair of upturned coupling ends (only one of which 32 being shown) located at and extending rearwardly from opposite sides thereof. A hinge enclosure 30 is affixed (e.g., welded) to each upturned coupling end 32 so as to stand upwardly therefrom. Each hinge enclosure 30 is hollow so as to receive therewithin and surround the lowermost end of a respective one of the vertical frame posts 22 located at opposite sides of the chair back 18. Each hinge enclosure 30 has an open top 34 through which a frame post 22 is slidably received, a front wall 36, a back wall 38 and opposite side walls 40. An elongated pivot receiving slot 42 extends vertically through each of the opposite side walls 40 of each hinge enclosure 30. The front wall 36 of each hinge enclosure 30 has an arcuate recess 44 formed therein so as to communicate with and extend downwardly from the open top 34.

Figure 4:
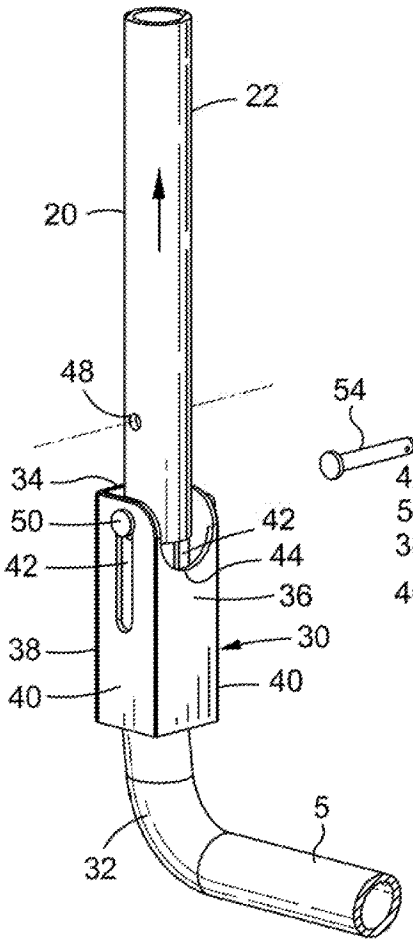
Figure 3:
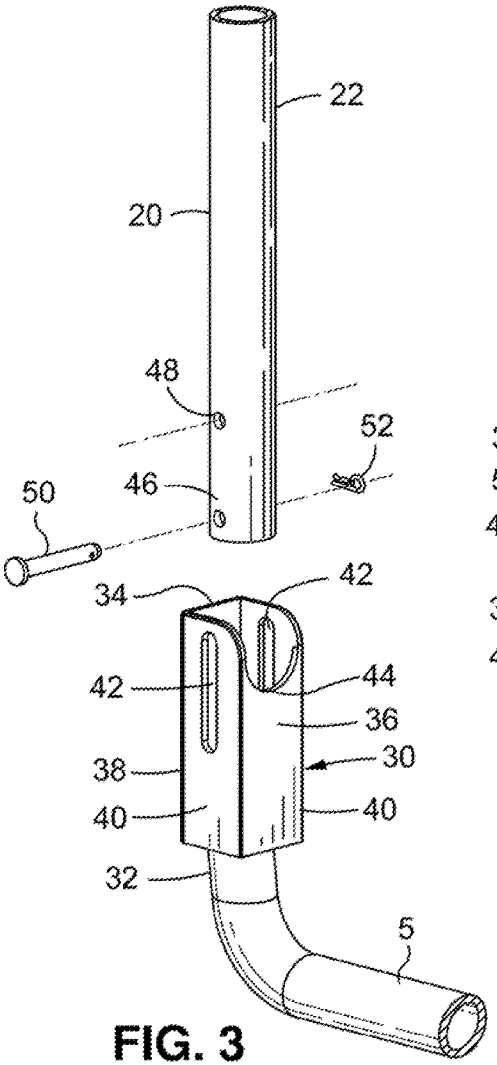

During the manufacture and assembly of the chair 1 and the rotatable connection of the chair back 18 to the chair seat 3, each of the pair of vertical frame posts 22 (only one of which being shown) from the outer frame 20 of the chair back 18 is moved through the open top 34 of and surrounded by a hollow hinge enclosure 30 that is affixed to one of the pair of upturned coupling ends 32 of the seat frame 5 (best shown in FIGS. 3 and 4). With the frame post 22 located inwardly of the hinge enclosure 30, the frame post 22 is pivotally attached by the manufacturer to the hinge enclosure 30 prior to the shipment of the chair to a retailer or a purchase of the chair by a consumer.

Referring in this regard specifically to FIGS. 3 and 4, each of the lower-most ends of the pair of vertical frame post 22 is shown having pairs of axially aligned holes 46 and 48 extending therethrough and located one above the other at opposite sides of the frame post 22. A first lower pair of axially aligned holes 46 are accessible to the manufacturer and, as will soon be explained, the second upper pair of axially aligned holes 48 are accessible to the end user (i.e., purchaser). More particularly, a first coupler (e.g., a pivot pin) 50 is inserted by the manufacturer through the pivot receiving slots 42 formed in the opposite side walls 40 of the hinge enclosure 30 and through the lower pair of axially aligned manufacturer accessible holes 46 formed through the lower-most end of each frame post 22. A first retainer (e.g., a cotter pin) 52 is then pushed by the manufacturer through the outwardly extending end of the pivot pin 50 to hold the pin in place and maintain the pivotal connection of the chair back 18 to the chair seat 3.

By virtue of the foregoing, the fold-down chair back 18 is now rotatable at the pivot pins 50 that extend through the pair of frame posts 22 in a clockwise direction through an angle of about 90 degrees between a vertical position (best shown in FIGS. 1 and 2) standing upwardly from the seat 3 and a horizontal folded position (best shown in FIGS. 7 and 8) lying over and in opposite facing alignment with the seat 3. To permit the chair back 18 to rotate relative to the chair seat 3 to its folded position, the chair back 18 is initially pulled upwardly and away from the chair seat 3 in the direction of the reference arrow shown in FIG. 4 such that each vertical frame post 22 slides upwardly through its hinge enclosure 30, and the pivot pin 50 carried by the frame post 22 correspondingly rides upwardly through the opposing pin receiving slots 42. Each vertical frame post 22 of the back frame 20 that projects upwardly through the open top 34 of a hinge enclosure 30 is now rotated downwardly at the pivot pin 50 towards the seat 3 and into receipt by the arcuate recess 44 that communicates with the open top 34 at the front wall 36 of enclosure 30 (best shown in FIG. 8).

Figure 7:
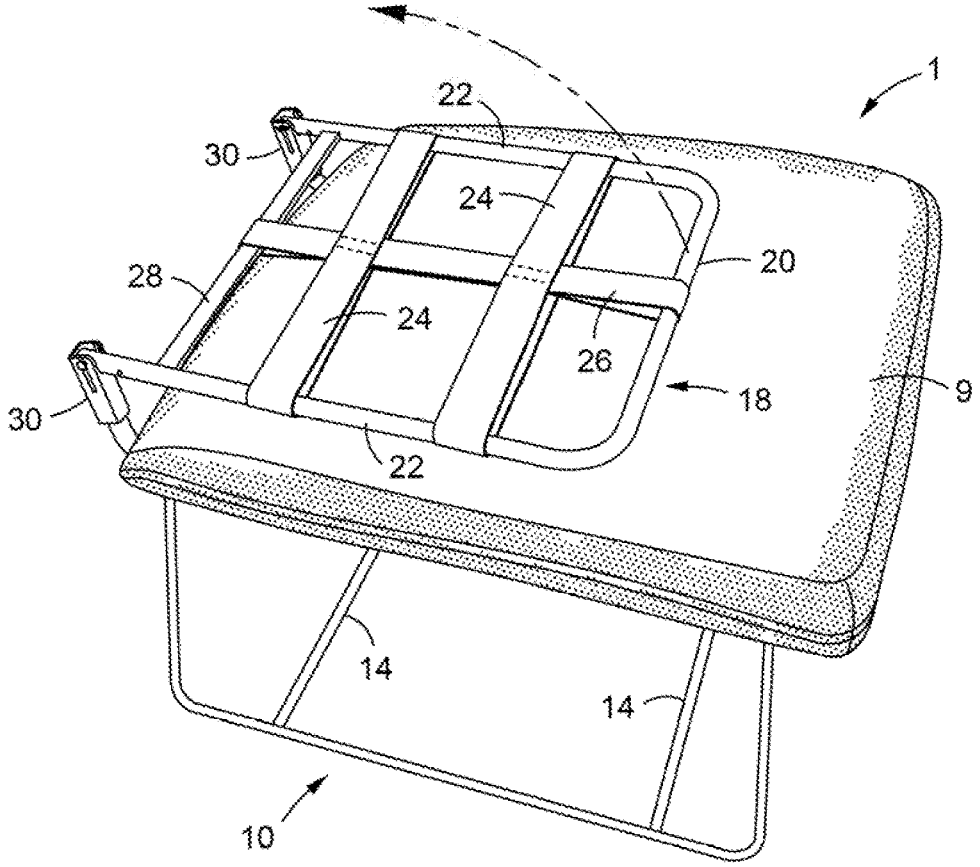
FIGS. 7 and 8 show the fold-down back of the hinged chair rotated at the pivot couplers to a horizontal folded position lying over and in opposite facing alignment with the seat of the chair so that the chair is ideally configured to be shipped in a compact container.
Figure 8:
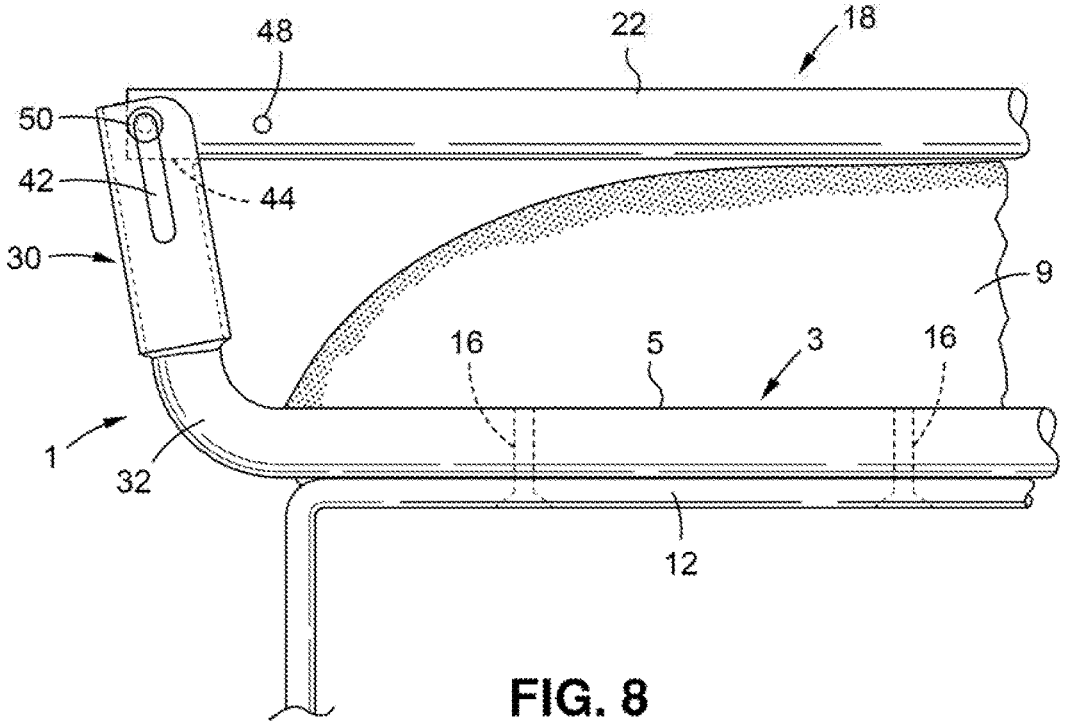

With the chair back 18 in its aforementioned horizontal folded position of FIGS. 7 and 8, the profile of the chair 1 is advantageously reduced to further facilitate its being shipped and transported disassembled in a compact box or similar container within which to be carried to its ultimate destination. Once the chair 1 has been delivered to its ultimate destination, it is removed from the compact shipping box to be assembled and used by the purchaser.

Figure 6:
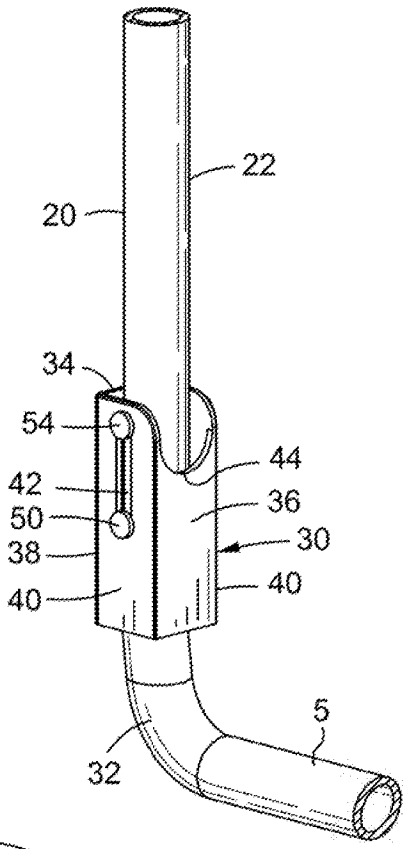
FIGS. 3-6 show details by which a frame of the fold-down back of the hinged chair of FIG. 1 is pivotally connected to a frame of the seat of the chair by means of pivot couplers so that the chair back is rotatable relative to the chair seat.
Figure 5:
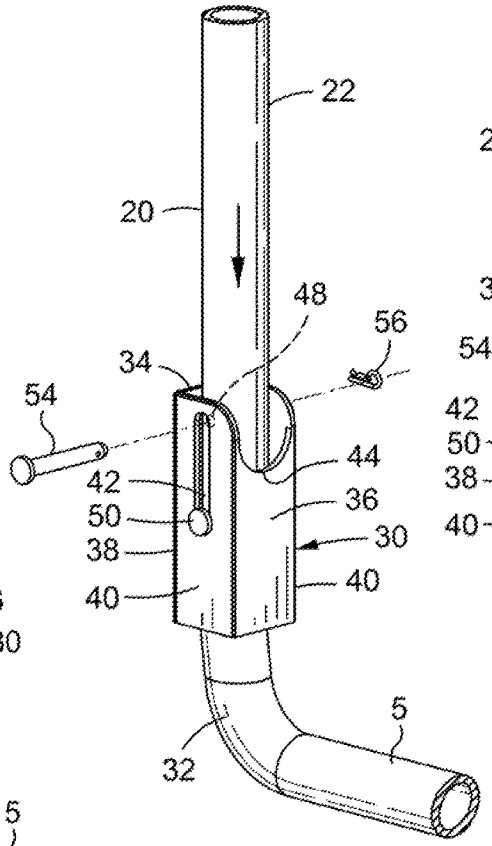

Referring specifically to FIGS. 5 and 6, the user rotates the chair back 18 at the pivot pins 50 in an opposite counter-clockwise direction (represented by the reference arrow shown in FIG. 7) through the aforementioned 90 degree angle from its horizontal folded position as packaged to its aforementioned vertical upstanding position of FIGS. 1 and 2 at which to be made ready for use. In this case, each frame post 22 of the frame 20 of the chair back 18 is moved out of the recess 44 of the hinge enclosure 30 in which the frame post had formerly been received. Following its rotation, the chair back 18 is pushed downwardly towards the chair seat 3 in the direction of the reference arrow shown in FIG. 5 such that each vertical frame post 22 slides downwardly through its hinge enclosure 30, and the pivot pin 50 that is carried by the frame post 22 correspondingly rides downwardly through the opposing pin receiving slots 42.

After the fold-down chair back 18 has been rotated to its vertical upstanding position and pushed downwardly towards the chair seat 3, the user inserts second couplers (e.g., locking pins), only one of which 54 being shown, through the pivot receiving slots 42 that are formed in the opposite side walls 40 of each hinge enclosure 30 and through the upper pair of axially aligned user accessible holes 48 that are formed through the lower-most end of each frame post 22 above the pair of manufacturer accessible holes 46. A second retainer (e.g., a cotter pin) 56 is then pushed by the user through the outwardly extending end of the locking pin 54 to hold the locking pin in place and thereby prevent the frame post 22 from one again sliding upwardly through its hinge enclosure 30.

Figure 9:
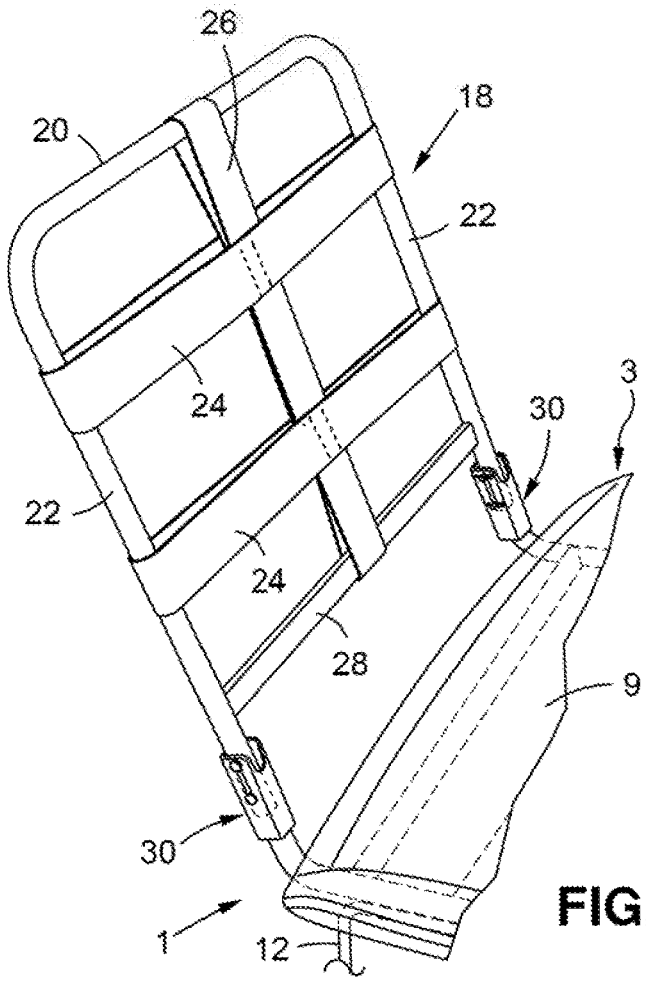
FIGS. 9 and 10 show the fold-down back of the hinged chair rotated to and locked in place in a vertical position standing upwardly from the seat after the chair has been removed from its compact shipping container and made ready for use.
Figure 10:
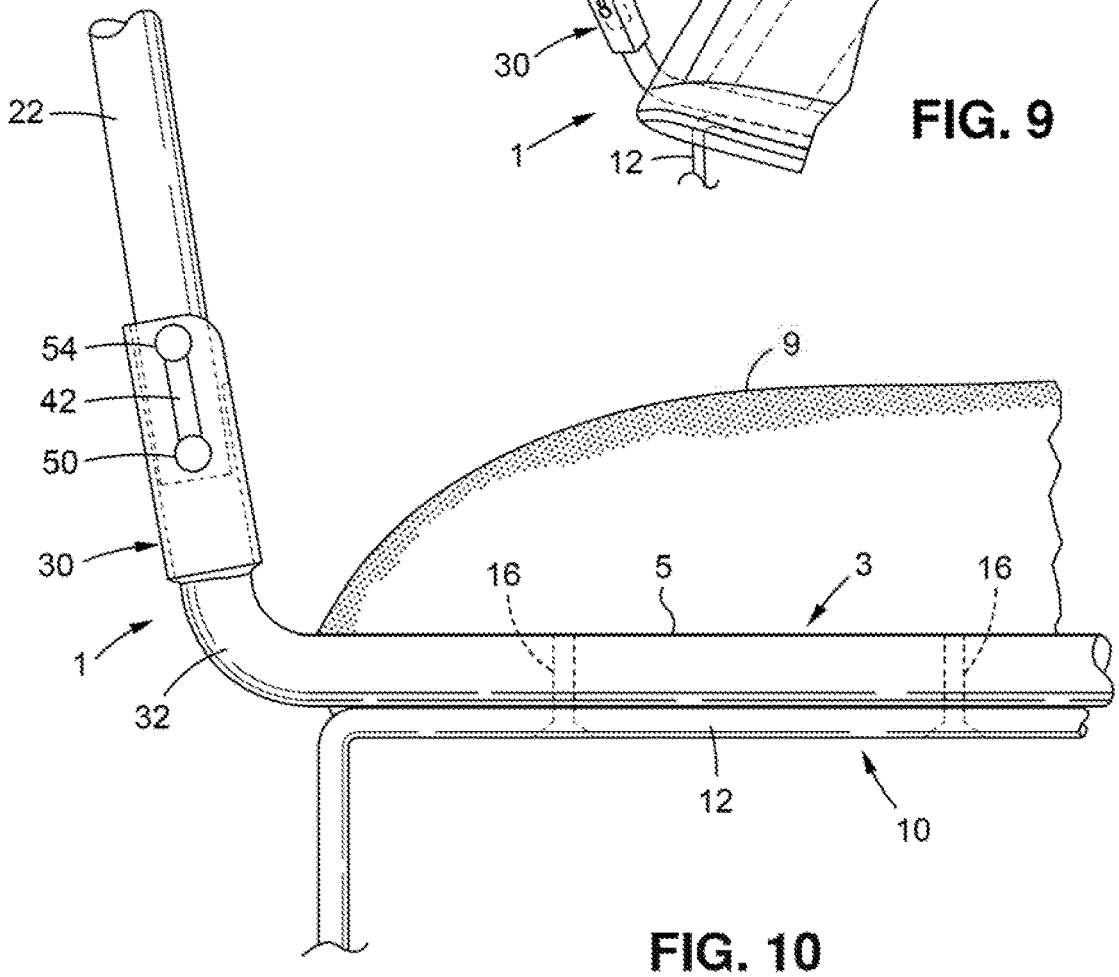

Referring concurrently to FIGS. 9 and 10 of the drawings, the hinged chair 1 is shown after the user has rotated the fold-down back 18 to its vertical upstanding position and inserted the locking pins 54 into the opposing pin receiving slots 42 of the hinge enclosures 30 and through respective ones of the pairs of axially aligned user accessible holes 48 formed in each of the pair of frame posts 22 that are received in and surrounded by the hinge enclosures. With the pair of frame posts 22 pushed downwardly through the hinge enclosures 30 and both the first and second manufacturer and user installed pivot and locking pins 50 and 54 extending one above the other through each of the frame posts 22 of the outer frame 20 of the fold-down chair back 18, the chair back 18 is now held stationary and locked in place in its vertically upstanding position shown in FIGS. 9 and 10. That is to say, the combination of the pivot and locking pins 50 and 54 prevent the chair back 18 from moving vertically relative to the hinge enclosures 30 or rotating within the hinge enclosures 30 towards the horizontal folded position of FIGS. 7 and 8.

Figure 12:
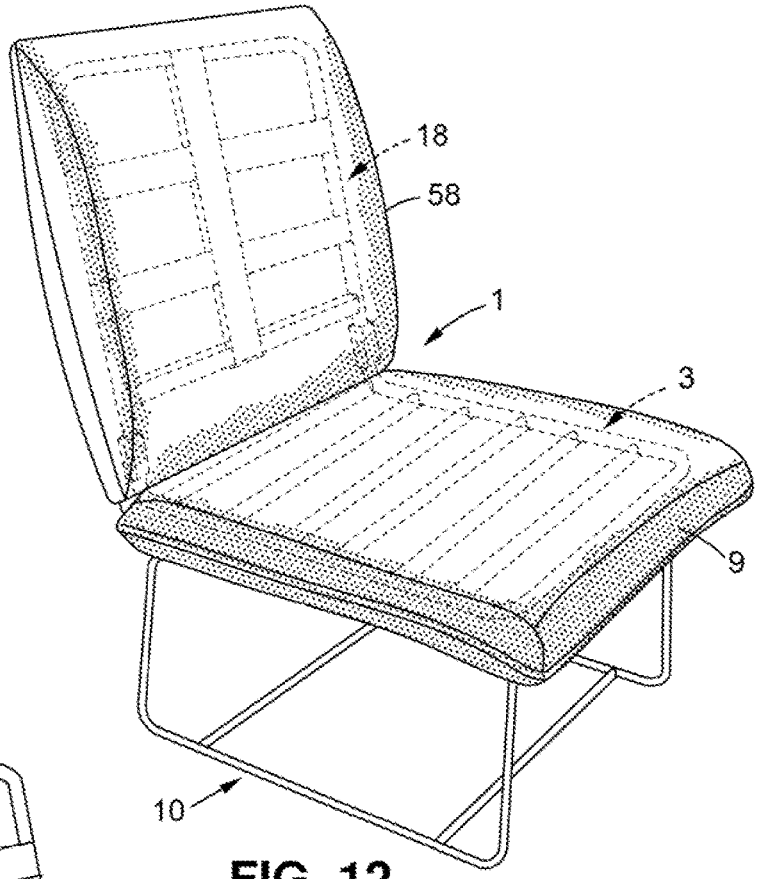
FIGS. 11 and 12 show an optional cushion back rest sliding over and surrounding the fold-down back of the hinged chair.
Figure 11:
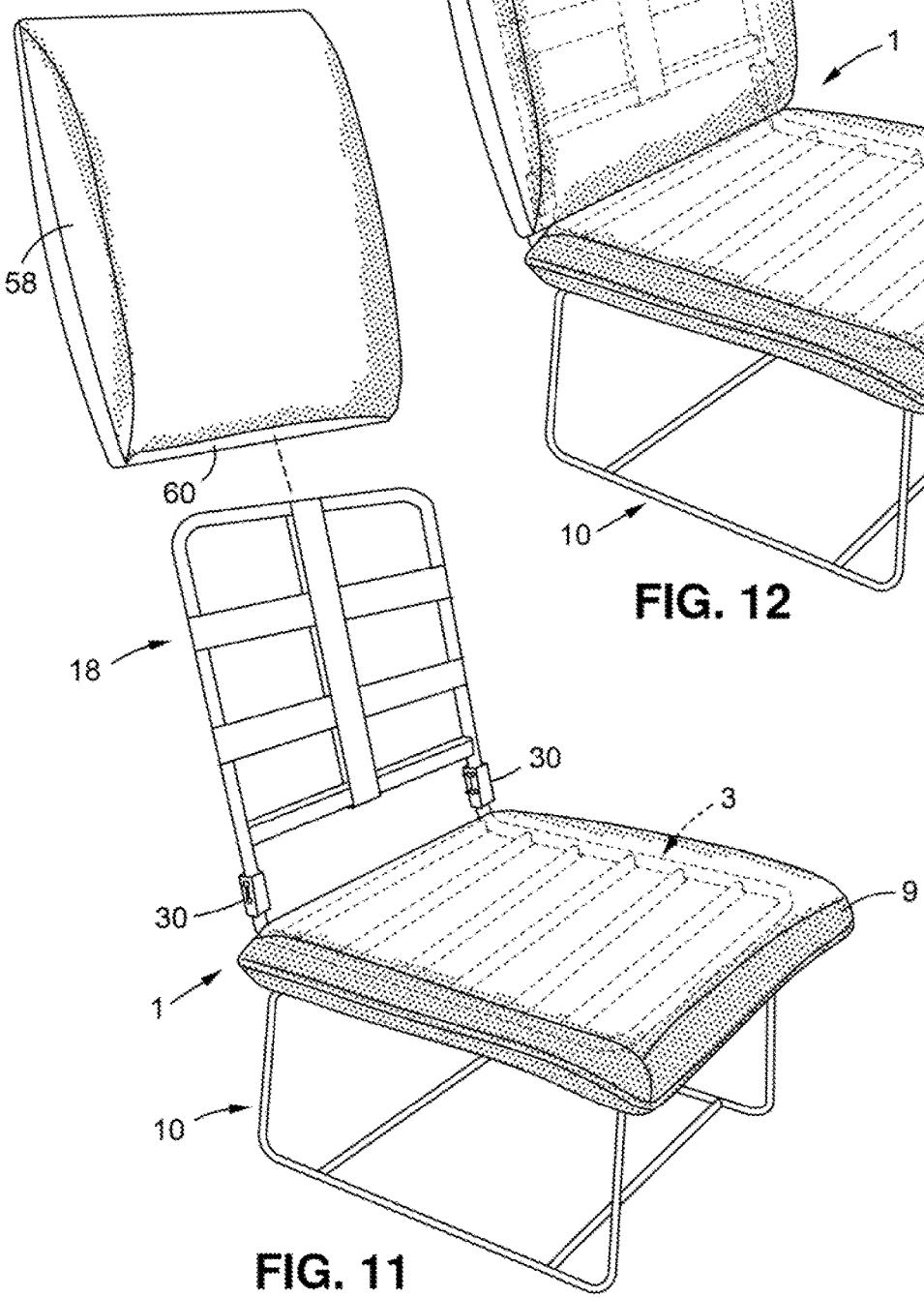

The assembly of the chair 1 is completed and made ready for use when the user attaches the base 10 to the seat 3 by means of installing the fasteners 16 in the manner previously described when referring to FIGS. 1 and 2. Prior to using the assembled chair 1, the user may slide an optional cushion back rest 58 downwardly over and around the chair back 18 as shown in FIGS. 11 and 12. The cushion back rest 58 has an inside pocket 60 that is sized to receive therewithin and surround the chair back 18 so as to cooperate with the seat cushion 9 to enhance the comfort of one seated in the chair 1.

It has been described above that the chair base 10 is attached to the bottom of the chair seat 3 after the chair back 18 has been rotated to and locked in its vertically upstanding position. However, for convenience during assembly of the chair 1, the base 10 can also be attached first to the seat 3 while the chair back 18 is still in its horizontal folded position. In either event, the chair 1 described herein is advantageously capable of being shipped from the manufacturer to the end user in an efficient compact configuration that is ideally suited for transport in a compact shipping container.

The invention claimed is:

1. A chair to sit on the ground and comprising:

a seat having first and second upturned frame posts extending therefrom;

a base connected to the seat to hold the seat above the ground;

a back having first and second back posts extending therefrom;

first and second pivots; and first and second hinge enclosures, one of said hinge enclosures being fixedly connected to and standing upwardly from one of the first and second upturned frame posts of said seat to surround one of the first and second back posts of said back, the one of said first and second hinge enclosures having a pivot receiving slot formed therein; and one of said first and second pivots extending through the pivot receiving slot formed in the one of said first and second hinge enclosures and the one of the first and second back posts surrounded by said one hinge enclosure such that said back is hingedly coupled to and rotatable relative to said seat between an upstanding position extending upwardly from said seat and a folded position lying over and in opposite facing alignment with said seat, wherein the one of the first and second back posts of said back is slidable upwardly and downwardly through the one of said first and second hinge enclosures and the one of said first and second pivots is correspondingly slidable upwardly and downwardly through the pivot receiving slot formed in said one hinge enclosure, said back rotating from said upstanding position to said folded position when the one of the first and second back posts slides upwardly through the one of said first and second hinge enclosures and the one of said first and second pivots slides upwardly through said pivot receiving slot.

2. The chair recited in claim 1, wherein said back is rotatable relative to said seat through an angle of substantially 90 degrees between said upstanding position and said folded position.

3. The chair recited in claim 1, wherein said back extends vertically upward from said seat when said back is in said upstanding position, and said back extends horizontally over and in opposite facing alignment with said seat when said back is in said folded position.

4. The chair recited in claim 1, wherein said base is detachably connected to and removable from said seat.

5. The chair recited in claim 1, wherein the one of said first and second hinge enclosures has an open top through which to receive the one of the first and second back posts of said back and a recess formed therein and extending downwardly from said open top towards said seat, said one back post being received within said recess when said back is rotated to said folded position.

6. The chair recited in claim 1, wherein the back of said chair moves vertically upward and away from the seat of said chair when the one of the first and second back posts of said back slides upwardly through the one of said first and second hinge enclosures and the one of said first and second pivots slides upwardly through said pivot receiving slot.

7. The chair recited in claim 6, further comprising a locking pin to be received through the one of the first and second back posts of said back and the one of said first and second hinge enclosures by way of the pivot receiving slot formed in said one hinge enclosure after the back of said chair rotates from said folded position to said upstanding position and said one back post slides downwardly through said one hinge enclosure and the one of said first and second pivots slides downwardly through said pivot receiving slot, whereby the back of said chair moves vertically downward and towards the seat of said chair.

8. The chair recited in claim 7, wherein the one of said first and second pivots and said locking pin are received through the one of said first and second back posts of said back and the one of said first and second hinge enclosures by way of the pivot receiving slot formed in said one hinge enclosure after the back of said chair is rotated from said folded position to said upstanding position, said locking pin lying above said one pivot to lock the back of said chair in said upstanding position.

9. A chair comprising:

a seat having at least one back supporting post extending upwardly therefrom;

a back having at least one back coupling post extending downwardly therefrom;

at least one pivot; and a hinge enclosure fixedly connected to and standing upwardly from the back supporting post of said seat to surround the back coupling post of said back, said hinge enclosure having a pivot receiving slot formed therein, and said pivot extending through said pivot receiving slot and said back coupling post surrounded by said hinge enclosure such that said back is hingedly coupled to and rotatable relative to said seat between an upstanding position extending upwardly from said seat and a folded position lying over and in opposite facing alignment with said seat, wherein the back coupling post of said back is slidable upwardly and downwardly through said hinge enclosure and said pivot is correspondingly slidable upwardly and downwardly through the pivot receiving slot formed in said hinge enclosure, said back rotating from said upstanding position to said folded position when said back coupling post slides upwardly through said hinge enclosure and said pivot slides upwardly through said pivot receiving slot.

10. The chair recited in claim 9, wherein said hinge enclosure has a top through which the back coupling post of said back extends, said hinge enclosure having a recess formed therein and extending downwardly from the top thereof, and said back coupling post being received within said recess when said back is rotated to said folded position.

11. The chair recited in claim 9, further comprising a locking pin received through the back coupling post of said back and said hinge enclosure by way of the pivot receiving slot formed in said hinge enclosure after the back of said chair rotates from said folded position to said upstanding position, said back coupling post slides downwardly through said hinge enclosure and said pivot slides downwardly through said pivot receiving slot, whereby the back of said chair moves vertically downward towards the seat of said chair and said locking pin locks said back in said upstanding position.

* * * * *